US007605544B2

(12) United States Patent
Ushijima et al.

(10) Patent No.: US 7,605,544 B2
(45) Date of Patent: Oct. 20, 2009

(54) CURRENT BALANCING CIRCUIT

(75) Inventors: Masakazu Ushijima, Tokyo (JP); Ting-Cheng Lai, Taichung (TW); Wan-Lu Lin, Taichung (TW); Te-Min Liu, Taichung (TW); Chien-Fu Ho, Taichung (TW)

(73) Assignee: Greatchip Technology Co., Ltd., Taichung (TW)

( * ) Notice: Subject to any disclaimer, the term of this patent is extended or adjusted under 35 U.S.C. 154(b) by 204 days.

(21) Appl. No.: 11/899,509

(22) Filed: Sep. 6, 2007

(65) Prior Publication Data

US 2008/0061710 A1 Mar. 13, 2008

(30) Foreign Application Priority Data

Sep. 13, 2006 (TW) ..... 95133835 A

(51) Int. Cl.
*H05B 41/16* (2006.01)

(52) U.S. Cl. ..... 315/282; 315/277; 315/274; 315/209 R; 315/312

(58) Field of Classification Search ..... 315/274–290, 315/312–324, 224.291, 307, 247, 246, 224, 315/209 R See application file for complete search history.

(56) References Cited

U.S. PATENT DOCUMENTS 6,781,325 B2 8/2004 Lee
7,319,296 B2 * 1/2008 Meng et al. ..... 315/282
2005/0093472 A1 5/2005 Jin
2007/0126369 A1 * 6/2007 Meng et al. ..... 315/282

FOREIGN PATENT DOCUMENTS

EP 1 517 591 A1 3/2005

* cited by examiner

*Primary Examiner*—Tuyet Vo
(74) *Attorney, Agent, or Firm*—Simpson & Simpson, PLLC

(57) ABSTRACT

A current balancing circuit for first and second lamp sets includes a step-up transformer and a current balancer. The step-up transformer is adapted to be coupled to a power supply for receiving an alternating-current source power, and for generating a drive signal by varying magnitude of the alternating-current source power. The step-up transformer is further adapted to be coupled to the first and second lamp sets for providing the drive signal thereto. The current balancer includes first and second shunt transformers. Each of the first and second shunt transformers includes primary and secondary windings that correspond to each other in number of turns thereof. The first and second shunt transformers are adapted to be coupled to corresponding discharge lamps of the first lamp set. The current balancer is adapted to mirror current flowing through the first and second shunt transformers to the second lamp set.

18 Claims, 10 Drawing Sheets

CURRENT BALANCING CIRCUIT

CROSS-REFERENCE TO RELATED APPLICATION

This application claims priority of Taiwanese Application No. 095133835, filed on Sep. 13, 2006.

BACKGROUND OF THE INVENTION

1. Field of the Invention

The invention relates to a current balancing circuit, more particularly to a current balancing circuit for a discharge lamp unit.

2. Description of the Related Art

In recent years, discharge lamps such as cold cathode florescent lamps, external electrode cold cathode fluorescent lamps, etc., have been widely used in liquid crystal display devices for providing source light. When a plurality of discharge lamps are coupled in a parallel configuration, it is relatively difficult to ensure balance among the currents flowing therethrough due to impedance differences among the discharge lamps, thereby resulting in unbalanced luminance of the source light.

As shown in FIG. 1, as disclosed in European patent publication no. EP1,517,591(A1), a first conventional current balancing circuit for a discharge lamp unit 11 includes a step-up transformer 13 and a current balancer 14. The discharge lamp unit 11 includes first, second, third, fourth, fifth and sixth discharge lamps 111~116. One end of each of the first, second, third, fourth, fifth and sixth discharge lamps 111~116 is grounded.

The step-up transformer 13 is adapted to be coupled electrically to a power supply 12 for receiving an alternating-current source power therefrom, and for generating a drive signal by varying magnitude of the alternating-current source power.

The current balancer 14 includes first, second, third, fourth and fifth shunt transformers 141~145, each of which includes primary and secondary windings. One end of each of the primary and secondary windings of the first shunt transformer 141 is coupled electrically to the step-up transformer 13 for receiving the drive signal therefrom. The other end of the primary winding of the first shunt transformer 141 is coupled electrically to one end of each of the primary and secondary windings of the second shunt transformer 142. The other end of the primary winding of the second shunt transformer 142 is coupled electrically to one end of each of the primary and secondary windings of the third shunt transformer 143. The other ends of the primary and secondary windings of the third shunt transformer 143 are adapted to be coupled electrically to the other ends of the first and second discharge lamps 111, 112, respectively. The other end of the secondary winding of the second shunt transformer 142 is coupled electrically to one end of each of the primary and secondary windings of the fourth shunt transformer 144. The other ends of the primary and secondary windings of the fourth shunt transformer 144 are adapted to be coupled electrically to the other ends of the third and fourth discharge lamps 113, 114, respectively. The other end of the secondary winding of the first shunt transformer 141 is coupled electrically to one end of each of the primary and secondary windings of the fifth shunt transformer 145. The other ends of the primary and secondary windings of the fifth shunt transformer 145 are adapted to be coupled electrically to the other ends of the fifth and sixth discharge lamps 115, 116, respectively.

Numbers of turns of the primary and secondary windings of the first shunt transformer 141 have a ratio of 1:2, such that the currents flowing through the primary and secondary windings of the first shunt transformer 141 have a ratio of approximately 2:1. The primary and secondary windings of each of the second, third, fourth and fifth shunt transformers 142~145 correspond to each other in number of turns thereof, i.e., the numbers of turns of the primary and secondary windings of each of the second, third, fourth and fifth shunt transformers 142~145 have a ratio of 1:1. Therefore, the currents flowing through the primary and secondary windings of each of the second, third, fourth and fifth shunt transformers 142~145 have a ratio of approximately 1:1. Consequently, differences among the currents flowing through the first to sixth discharge lamps 111~116 are small.

Although (P) parallel-connected discharge lamps can be driven with balanced currents by providing a current balancer with shunt transformers that are connected in a tournament tree structure as described above, and by suitably setting the ratio of the numbers of turns between the primary and secondary windings of each of the shunt transformers, it should be noted that (P−1) shunt transformers are required for such a configuration.

As shown in FIG. 2, as disclosed in U.S. Patent Application Publication No. 20050093472, a second conventional current balancing circuit for a discharge lamp unit 21 includes a step-up transformer 23 and a current balancer 24.

The discharge lamp unit 21 includes first, second, third, fourth, fifth and sixth discharge lamps 211~216. One end of each of the first to sixth discharge lamps 211~216 is grounded.

The step-up transformer 23 is adapted to be coupled to a power supply 22 for receiving an alternating-current source power therefrom. Since the step-up transformer 23 has functions similar to those in the first conventional current balancing circuit (shown in FIG. 1), further details of the same are omitted herein for the sake of brevity.

The current balancer 24 includes first, second, third, fourth, fifth and sixth shunt transformers 241~246, each of which includes primary and secondary windings. One end of the primary winding of each of the first to sixth shunt transformers 241~246 is coupled electrically to the step-up transformer 23 for receiving the drive signal therefrom. The other ends of the primary windings of the first to sixth shunt transformers 241~246 are adapted to be coupled electrically to the other ends of the first to sixth discharge lamps 211~216, respectively. The secondary windings of the first to sixth shunt transformers 241~246 are coupled electrically to each other in a serial ring configuration.

The first to sixth shunt transformers 241~246 have identical ratios of number of turns between the primary and secondary windings thereof. Since the secondary windings of the first to sixth shunt transformers 241~246 are coupled electrically to each other in the serial ring configuration, currents flowing therethrough are nearly identical, such that the currents flowing through the primary windings of the first to sixth shunt transformers 241~246 are nearly identical. Consequently, differences among the currents flowing through the first to sixth discharge lamps 211~216 are small.

However, for (P) parallel-connected discharge lamps to be driven by the second conventional current balancing circuit, (P) shunt transformers are needed.

As shown in FIG. 3, as disclosed in U.S. Pat. No. 6,781,325, a third conventional current balancing circuit for a discharge lamp unit 31 includes a step-up transformer 33, and a current balancer 34. The discharge lamp unit 31 includes first, second, third, fourth, fifth and sixth discharge lamps 311~316. One end of each of the first to sixth discharge lamps 311~316 is grounded.

The third conventional current balancing circuit differs from the second conventional current balancing circuit in the current balancer 34. The current balancer 34 includes first, second, third, fourth and fifth shunt transformers 341~345, each of which includes primary and secondary windings. One end of the primary winding of the first shunt transformer 341, and one end of the is secondary windings of each of the first to fifth shunt transformers 341~345 are coupled electrically to the step-up transformer 33. The other end of the primary winding of the first shunt transformer 341 is adapted to be coupled electrically to the other end of the first discharge lamp 311. The primary winding of the second shunt transformer 342 is adapted to be coupled electrically between the other end of the secondary winding of the first shunt transformer 341 and the other end of the second discharge lamp 312. The primary winding of the third shunt transformer 343 is adapted to be coupled electrically between the other end of the secondary winding of the second shunt transformer 342 and the other end of the third discharge lamp 313. The primary winding of the fourth shunt transformer 344 is adapted to be coupled electrically between the other end of the secondary winding of the third shunt transformer 343 and the other end of the fourth discharge lamp 314. The primary winding of the fifth shunt transformer 345 is adapted to be coupled electrically between the other end of the secondary winding of the fourth shunt transformer 344 and the other end of the fifth discharge lamp 315. The other end of the secondary winding of the fifth shunt transformer 345 is adapted to be coupled electrically to the other end of the sixth discharge lamp 316.

The primary and secondary windings of each of the first to fifth shunt transformers 311~315 correspond to each other in number of turns thereof. Therefore, the currents flowing through the primary and secondary windings of each of the first to fifth shunt transformers 311~315 have a ratio of approximately 1:1. Consequently, differences among the currents flowing through the first to sixth discharge lamps 311~316 are small.

However, for (P) parallel-connected discharge lamps to be driven by the third conventional current balancing circuit, (P−1) shunt transformers are required.

In other words, although each of the first to third conventional current balancing circuits is capable of providing balanced currents to a plurality of discharge lamps that are connected in parallel, manufacturing costs are kept high due to the large number of shunt transformers required therein.

SUMMARY OF THE INVENTION

Therefore, the object of the present invention is to provide a current balancing circuit for a discharge lamp unit that is capable of driving a plurality of discharge lamps of the discharge lamp unit with balanced currents by utilizing a smaller number of shunt transformers as compared to the prior art.

According to one aspect of the present invention, there is provided a current balancing circuit for a discharge lamp unit. The discharge lamp unit includes a first lamp set and a second lamp set. The first lamp set includes first, second, third and fourth discharge lamps. The second lamp set includes at least one discharge lamp. The current balancing circuit includes a step-up transformer and a current balancer.

The step-up transformer is adapted to be coupled electrically to a power supply for receiving an alternating-current source power therefrom, and for generating a drive signal by varying magnitude of the alternating-current source power. The step-up transformer is further adapted to be coupled electrically to the first and second lamp sets of the discharge lamp unit for providing the drive signal thereto.

The current balancer includes first and second shunt transformers. Each of the first and second shunt transformers includes primary and secondary windings that correspond to each other in number of turns thereof. One end of each of the primary and secondary windings of the first shunt transformer is adapted to be coupled electrically to a corresponding one of the first and second discharge lamps of the first lamp set. The other end of the primary winding of the first shunt transformer is coupled electrically in series to the other end of the secondary winding of the first shunt transformer. One end of each of the primary and secondary windings of the second shunt transformer is adapted to be coupled electrically to a corresponding one of the third and fourth discharge lamps of the first lamp set. The other end of the primary winding of the second shunt transformer is coupled electrically in series to the other end of the secondary winding of the second shunt transformer and to the other ends of the primary and secondary windings of the first shunt transformer. The current balancer is further adapted to mirror current flowing through the first and second shunt transformers to the second lamp set.

According to another aspect of the present invention, there is provided a current balancing circuit for a discharge lamp unit. The discharge lamp unit includes a first lamp set and a second lamp set. The first lamp set includes first, second, third and fourth discharge lamps. The second lamp set includes at least one discharge lamp. The current balancing circuit includes a step-up transformer and a current balancer.

The step-up transformer is adapted to be coupled electrically to a power supply for receiving an alternating-current source power therefrom, and for generating a drive signal by varying magnitude of the alternating-current source power. The step-up transformer is further adapted to be coupled electrically to the first and second lamp sets of the discharge lamp unit for providing the drive signal thereto.

The current balancer includes a first shunt transformer that includes primary and secondary windings. The primary and secondary windings of the first shunt transformer correspond to each other in number of turns thereof. The primary winding of the first shunt transformer is adapted to be coupled electrically between the first and second discharge lamps of the first lamp set. The secondary winding of the first shunt transformer is adapted to be coupled electrically between the third and fourth discharge lamps of the first lamp set. The current balancer is further adapted to mirror current flowing through the first shunt transformer to the second lamp set.

As used herein, mirroring of current can have a unity gain, or a scaling up/down factor.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
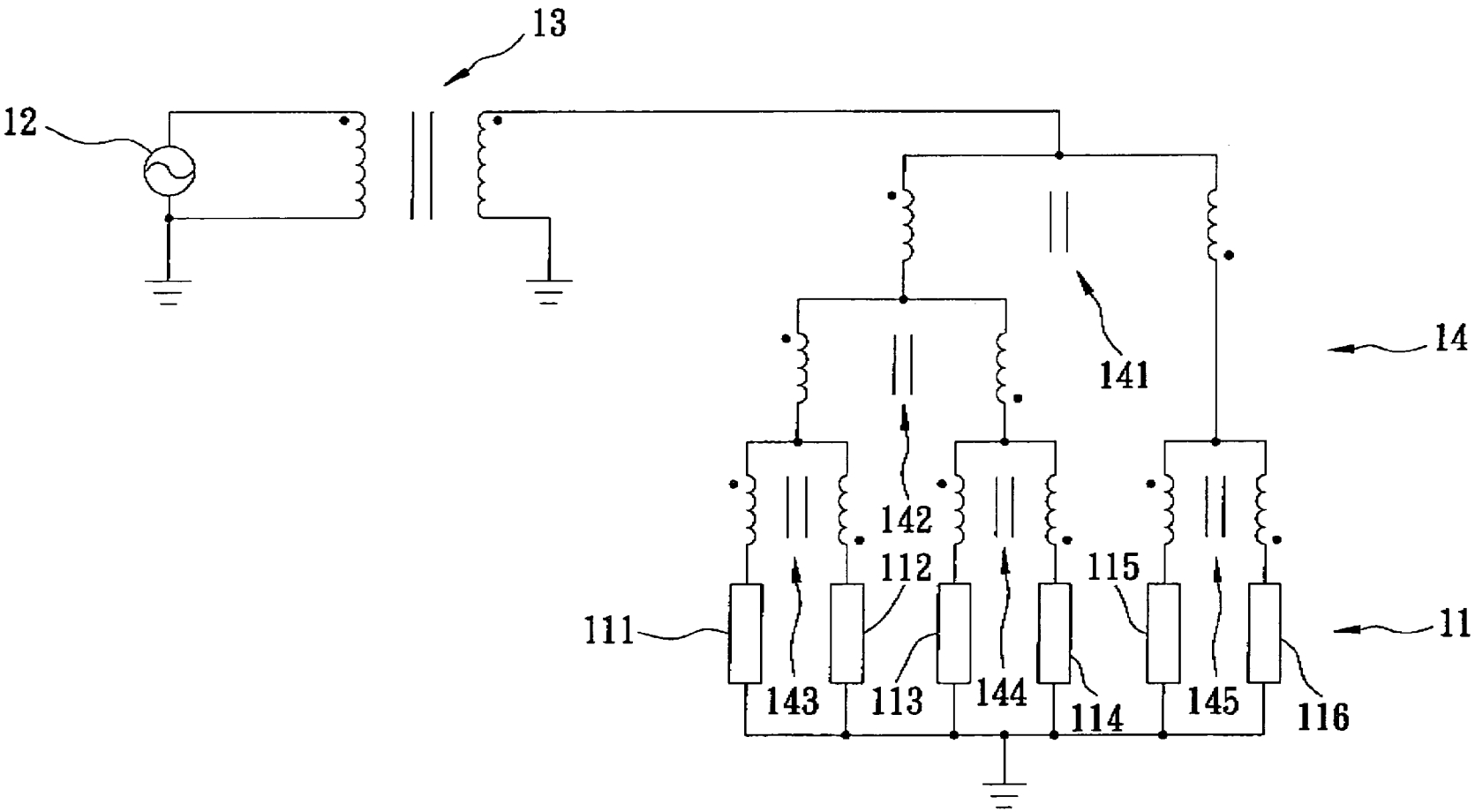
FIG. 1 PRIOR ART
FIG. 1 is a schematic circuit diagram, illustrating a first conventional current balancing circuit.
Figure 2:
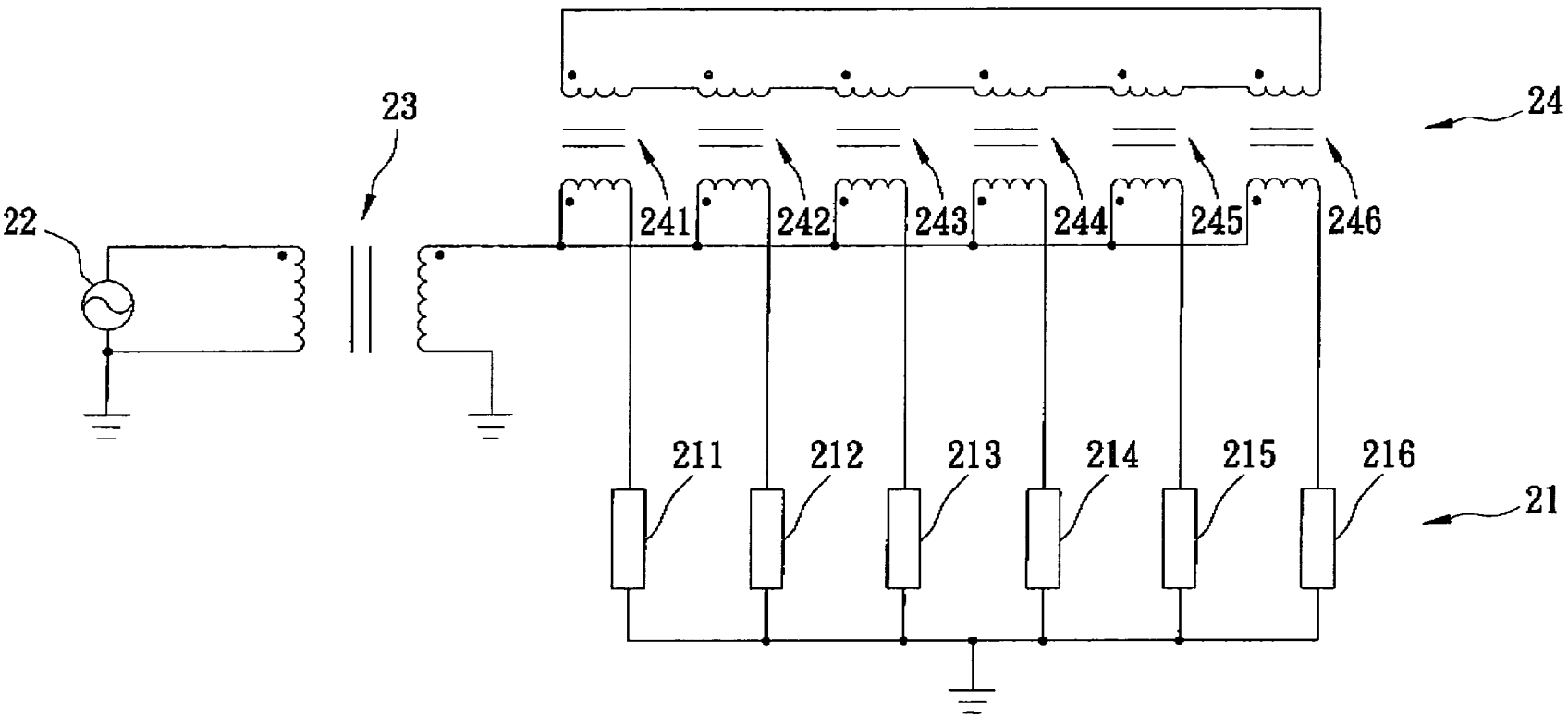
FIG. 2 PRIOR ART
FIG. 2 is a schematic circuit diagram, illustrating a second conventional current balancing circuit.
Figure 3:
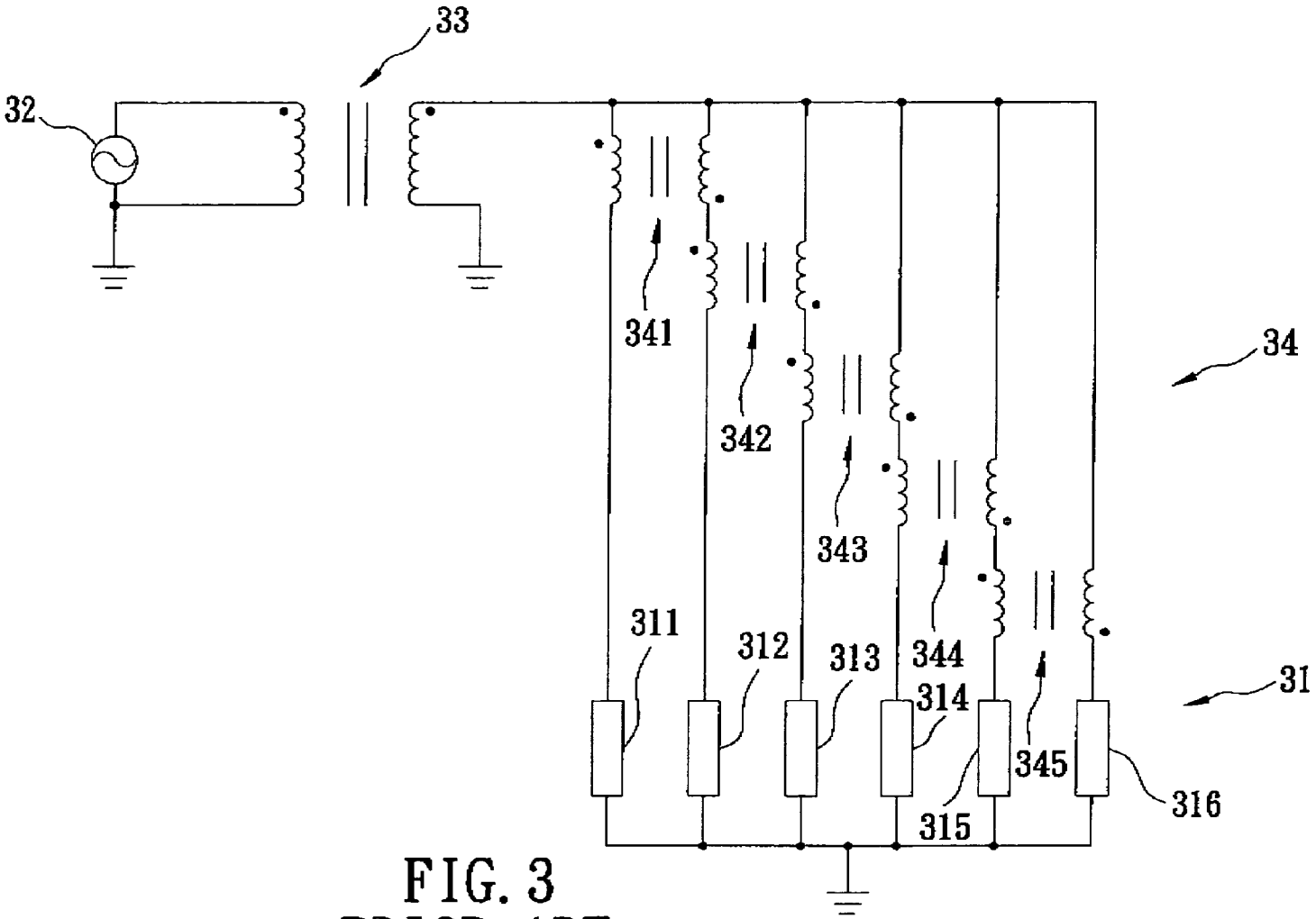
FIG. 3 PRIOR ART
FIG. 3 is a schematic circuit diagram, illustrating a third conventional current balancing circuit.

Before the present invention is described in greater detail, it should be noted that like elements are denoted by the same reference numerals throughout the disclosure.

Figure 4:
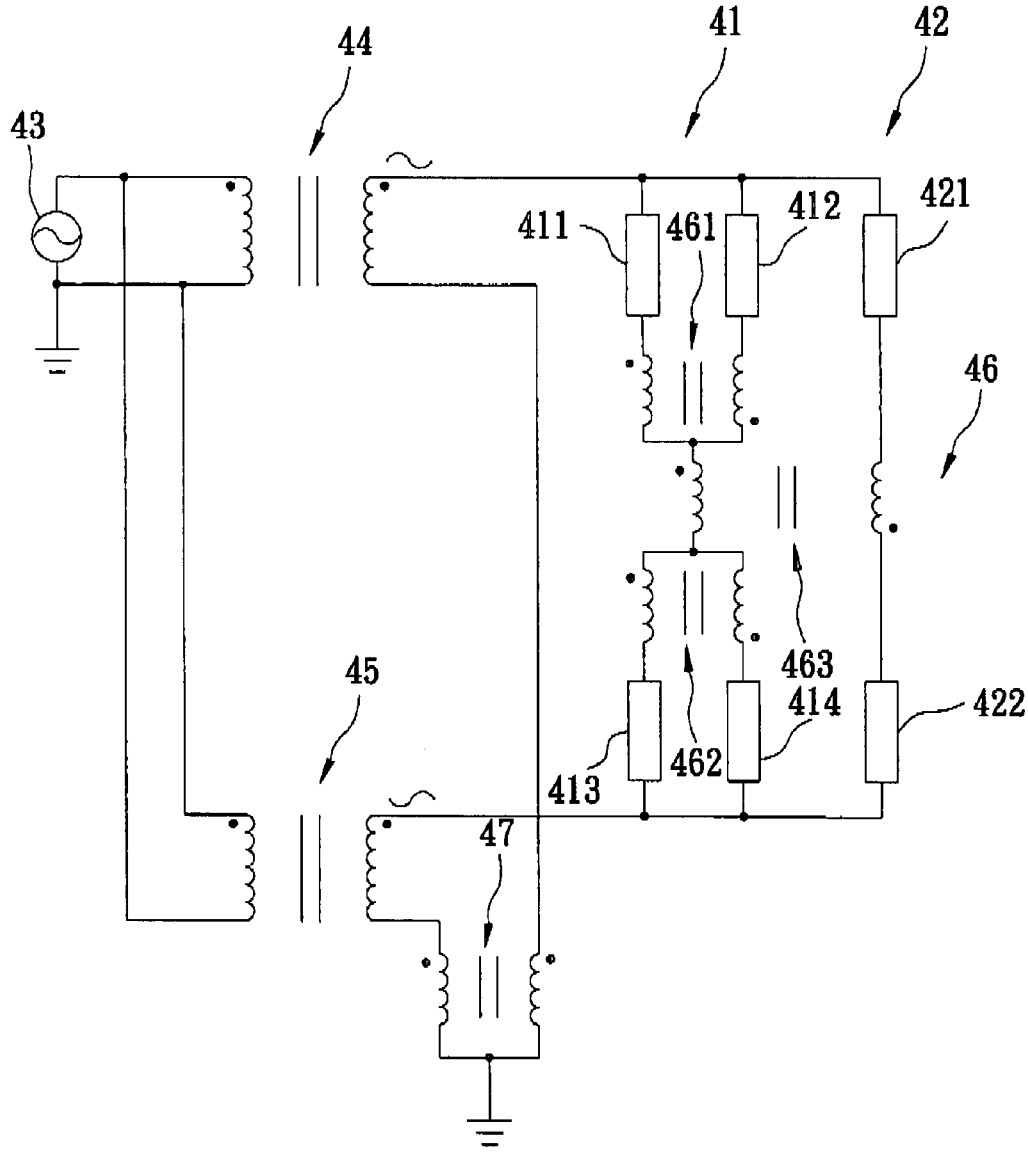
FIG. 4 is a schematic circuit diagram, illustrating a first implementation of the first preferred embodiment of a current balancing circuit according to the present invention.

Shown in FIG. 4 is a first implementation of the first preferred embodiment of a current balancing circuit for a discharge lamp unit according to the present invention. The discharge lamp unit includes a first lamp set 41 and a second lamp set 42. The first lamp set 41 includes first, second, third and fourth discharge lamps 411~414. The second lamp set 42 includes at least one discharge lamp 421. The current balancing circuit includes a step-up transformer 44 and a current balancer 46.

The step-up transformer 44 is adapted to be coupled electrically to a power supply 43 for receiving an alternating-current source power therefrom, and for generating a drive signal by varying magnitude of the alternating-current source power. The step-up transformer 44 is further adapted to be coupled electrically to the first and second lamp sets 41, 42 of the discharge lamp unit for providing the drive signal thereto.

The current balancer 46 includes first and second shunt transformers 461, 462. Each of the first and second shunt transformers 461, 462 includes primary and secondary windings. One end of each of the primary and to secondary windings of the first shunt transformer 461 is adapted to be coupled electrically to a corresponding one of the first and second discharge lamps 411, 412 of the first lamp set 41. The other end of the primary winding of the first shunt transformer 461 is coupled electrically in series to the other end of the secondary winding of the first shunt transformer 461. One end of each of the primary and secondary windings of the second shunt transformer 462 is adapted to be coupled electrically to a corresponding one of the third and fourth discharge lamps 413, 414 of the first lamp set 41. The other end of the primary winding of the second shunt transformer 462 is coupled electrically in series to the other end of the secondary winding of the second shunt transformer 462 and to the other ends of the primary and secondary windings of the first shunt transformer 461. The current balancer 46 is further adapted to mirror current flowing through the first and second shunt transformers 461, 462 to the second lamp set 42.

The primary and secondary windings of each of the first and second shunt transformers 461, 462 correspond to each other in number of turns thereof. In other words, the numbers of turns of the primary and secondary windings of each of the first and second shunt transformers 461, 462 have a ratio of 1:1. Consequently, the currents flowing through the primary and secondary windings of each of the first and second shunt transformers 461, 462, and in turn through each of the first and second discharge lamps 411, 412 in the corresponding pair and the third and fourth discharge lamps 413, 414 in the corresponding pair, have a ratio of approximately 1:1.

In this embodiment, the current balancer 46 further includes a third shunt transformer 463 that includes primary and secondary windings. The other ends of the primary and secondary windings of the second shunt transformer 462 are coupled electrically in series to the other ends of the primary and secondary windings of the first shunt transformer 461 via the primary winding of the third shunt transformer 463. The secondary winding of the third shunt transformer 463 is adapted to be coupled electrically to the at least one discharge lamp 421 of the second lamp set 42.

For the first implementation of the first preferred embodiment, the second lamp set 42 includes two discharge lamps, namely fifth and sixth discharge lamps 421, 422. The secondary winding of the third shunt transformer 463 is adapted to be coupled electrically between the fifth and sixth discharge lamps 421, 422 of the second lamp set 42. Numbers of turns of the primary and secondary windings of the third shunt transformer 463 have a ratio of 1:2. Consequently, the currents flowing through the primary and secondary windings of the third shunt transformer 463, and in turn through the first and second lamp sets 41, 42, have a ratio of approximately 2:1.

Furthermore, the current balancing circuit according to this embodiment includes two of the step-up transformers, namely first and second step-up transformers 44, 45. The first and second step-up transformers 44, 45 provide two of the drive signals to the first and second lamp sets 41,42 in a differential manner (i.e., with a phase difference of 180 degrees). In addition, the current balancing circuit further includes a balancing transformer 47 that includes primary and secondary windings.

More particularly, each of the first and second step-up transformers 44, 45 includes primary and secondary windings. The primary windings of the first and second step-up transformers 44, 45 are adapted to be coupled electrically to the power supply 43 for receiving the alternating-current source power therefrom. One end of the secondary winding of each of the first and second step-up transformers 44, 45 is adapted to be coupled electrically to corresponding ones of the discharge lamps of the first and second lamps sets 41, 42 for providing the drive signals thereto in the differential manner. In this implementation, the one end of the secondary winding of the first step-up transformer 44 is adapted to be coupled electrically to the first and second discharge lamps 411, 412 of the first lamp set 41, and to the fifth discharge lamp 421 of the second lamp set 42, while the one end of the secondary winding of the second step-up transformer 45 is adapted to be coupled electrically to the third and fourth discharge lamps 413, 414 of the first lamp set 41, and to the sixth discharge lamp 422 of the second lamp set 42. The other end of the secondary winding of each of the first and second step-up transformers 44, 45 is coupled electrically to one end of a corresponding one of the primary and secondary windings of the balancing transformer 47. The other end of each of the primary and secondary windings of the balancing transformer 47 is grounded.

The primary and secondary windings of the balancing transformer 47 correspond to each other in number of turns thereof, i.e., the numbers of turns of the primary and secondary windings of the balancing transformer 47 have a ratio of 1:1. Consequently, the currents flowing through the primary and secondary windings of the balancing transformer 47 have a ratio of approximately 1:1. Overall, differences among the currents flowing through the first to sixth discharge lamps 411~414, 421, 422 are small.

It should be noted herein that the balancing transformer 47 is optional in other embodiments of the present invention. However, current balancing effects of the current balancing circuit will be slightly degraded in the absence of the balancing transformer 47, where the other ends of the secondary windings of the first and second step-up transformers 44, 45 are grounded.

It should also be noted herein that in the absence of the second step-up transformer 45, i.e., the current balancing circuit only includes one step-up transformer 44, the other end of the secondary winding of the step-up transformer 44 is adapted to be coupled electrically to the third and fourth discharge lamps 413, 414 of the first lamp set 41 and to the sixth discharge lamp 422 of the second lamp set 42.

Figure 5:
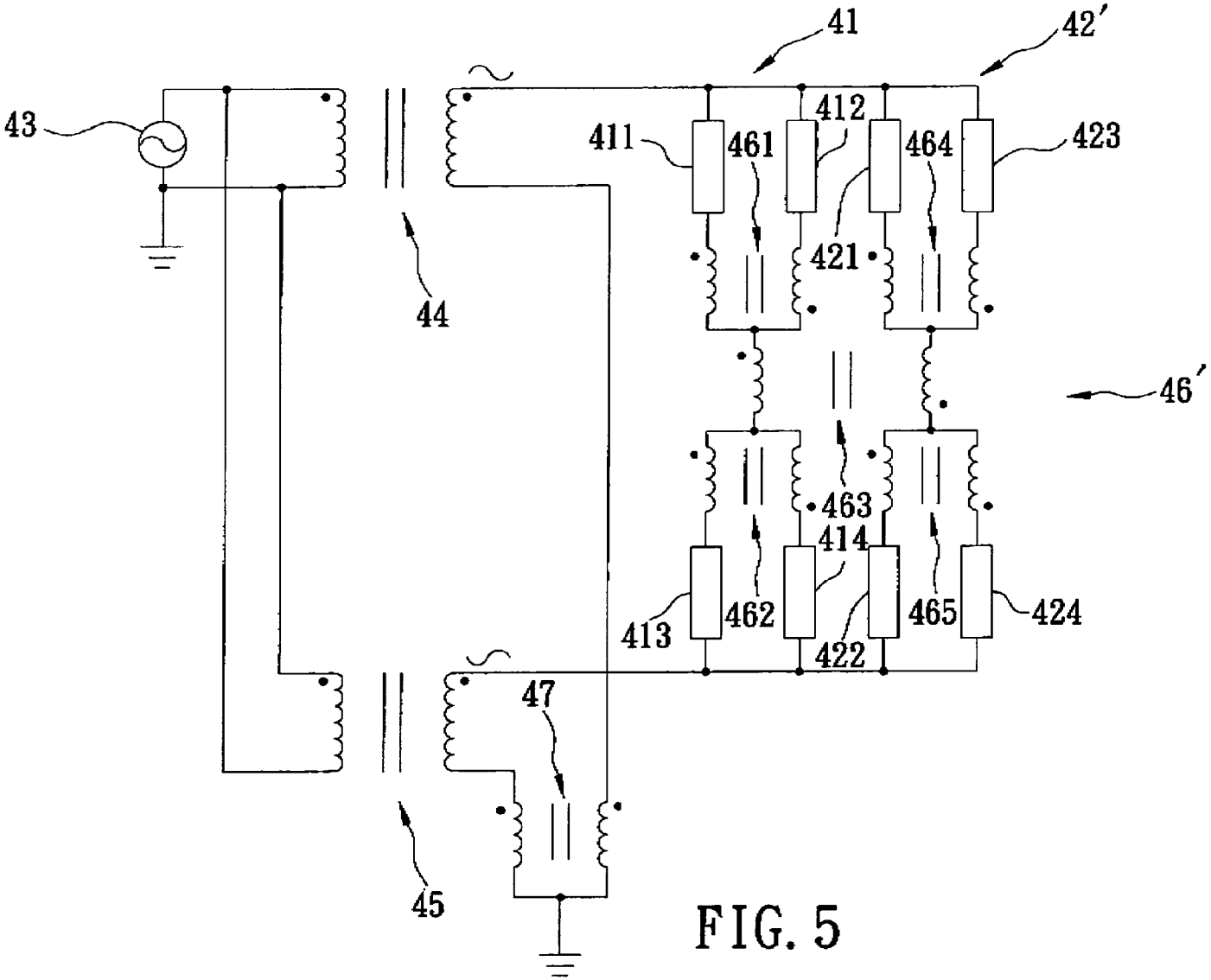
FIG. 5 is a schematic circuit diagram, illustrating a second implementation of the first preferred embodiment.

Shown in FIG. 5 is a second implementation of the first preferred embodiment of the current balancing circuit according to the present invention, where the second lamp set 42' of the discharge lamp unit includes four discharge lamps, namely fifth, sixth, seventh and eighth discharge lamps 421~424. The second implementation differs from the first implementation in that the current balancer 46' of the second implementation further includes fourth and fifth shunt transformers 464, 465. The one end of the secondary winding of the first step-up transformer 44 is further adapted to be coupled electrically to the seventh discharge lamp 423, and the one end of the secondary winding of the second step-up transformer 45 is further adapted to be coupled electrically to the eighth discharge lamp 424.

One end of each of the primary and secondary windings of the fourth shunt transformer 464 is adapted to be coupled electrically to a corresponding one of the fifth and seventh discharge lamps 421, 423 of the second lamp set 42. The other end of the primary winding of the fourth shunt transformer 464 is coupled electrically in series to the other end of the secondary winding of the fourth shunt transformer 464. One end of each of the primary and secondary windings of the fifth shunt transformer 465 is adapted to be coupled electrically to a corresponding one of the sixth and eighth discharge lamps 422, 424 of the second lamp set 42. The other end of the primary winding of the fifth shunt transformer 465 is coupled electrically in series to the other end of the secondary winding of the fifth shunt transformer 465 and to the other ends of the primary and secondary windings of the fourth shunt transformer 464 via the secondary winding of the third shunt transformer 463.

The primary and secondary windings of each of the fourth and fifth shunt transformers 464, 465 correspond to each other in number of turns thereof. In other words, the numbers of turns of the primary and secondary windings of each of the fourth and fifth shunt transformers 464, 465 have a ratio of 1:1. Consequently, the currents flowing through the primary and secondary windings of each of the fourth and fifth shunt transformers 464, 465, and in turn through each of the fifth and seventh discharge lamps 421, 423 in the corresponding pair and the sixth and eighth discharge lamps 422, 424 in the corresponding pair, have a ratio of approximately 1:1. In addition, different from the previous implementation, the primary and secondary windings of the third shunt transformer 463 correspond to each other in the number of turns thereof in this implementation, i.e., have a ratio of 1:1. Consequently, the currents flowing through the first and second lamp sets 41, 42 have a ratio of approximately 1:1. Overall, differences among the currents flowing through the first to eighth discharge lamps 411~414, 421~424 are small.

When the number of discharge lamps included in the second lamp set 42, 42' is neither two nor four, configuration and arrangement of the current balancer 46, 46' can be deducted from the previously described first and second implementations of the first preferred embodiment. Therefore, further details of the same are omitted herein for the sake of brevity.

Figure 6:
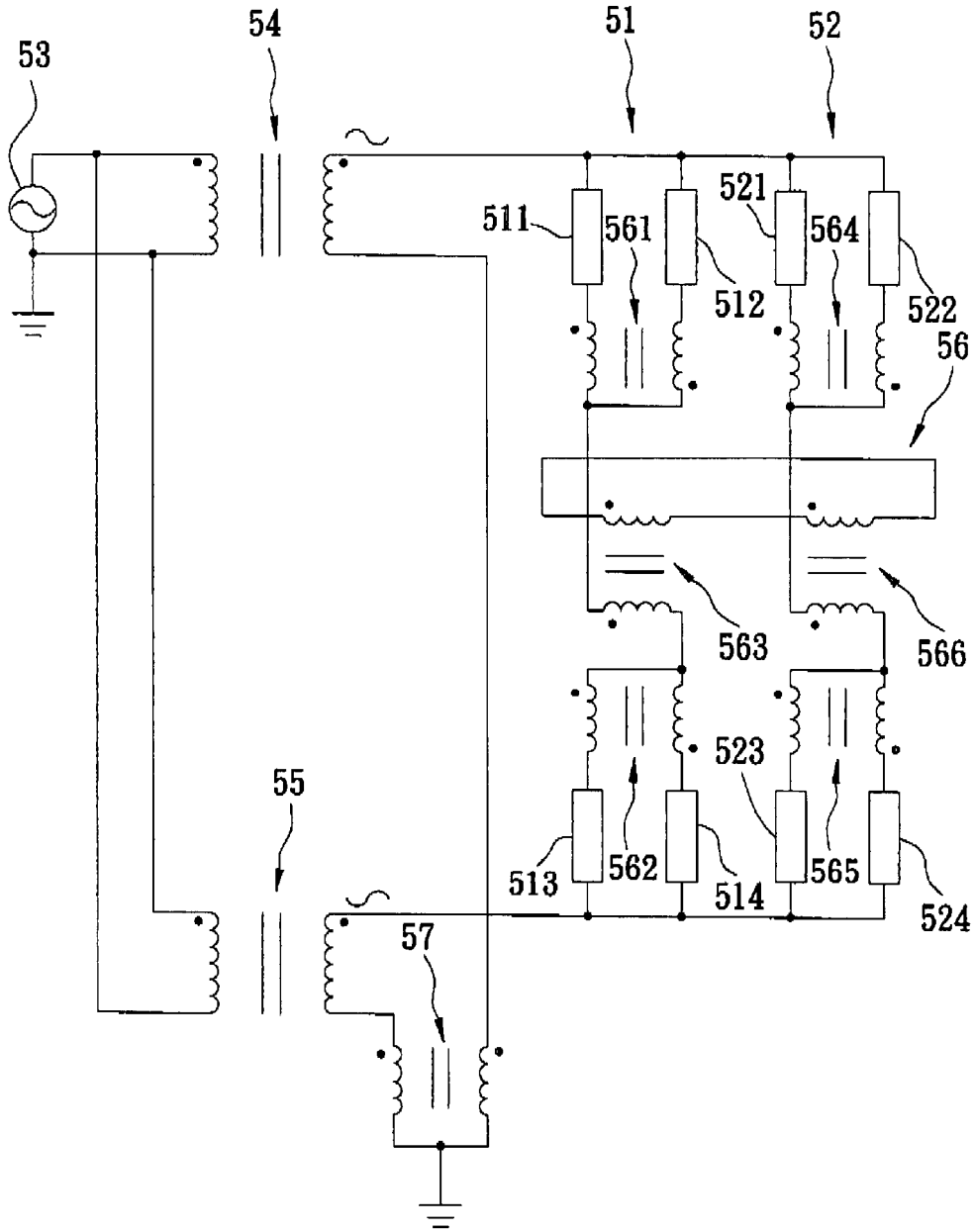
FIG. 6 is a schematic circuit diagram, illustrating a first implementation of the second preferred embodiment of a current balancing circuit according to the present invention.

Shown in FIG. 6 is a first implementation of the second preferred embodiment of a current balancing circuit for a discharge lamp unit according to the present invention. The discharge lamp unit includes a first lamp set 51 and a second lamp set 52. The first lamp set 51 includes first, second, third and fourth discharge lamps 511~514. The second lamp set 42 includes fifth, sixth, seventh and eighth discharge lamps 521~524. The current balancing circuit includes first and second step-up transformers 54, 55, a current balancer 56, and a balancing transformer 57.

Similar to the first preferred embodiment, each of the first and second step-up transformers 54, 55 includes primary and secondary windings. The primary windings of the first and second step-up transformers 54, 55 are adapted to be coupled electrically to a power supply 53 for receiving an alternating-current source power therefrom. The first and second step-up transformers 54, 55 generate two drive signals by varying magnitude of the alternating-current source power. One end of the secondary winding of each of the first and second step-up transformers 54, 55 is adapted to be coupled electrically to corresponding ones of the discharge lamps of the first and second lamps sets 51, 52 for providing the drive signals thereto in the differential manner.

The balancing transformer 57 includes primary and secondary windings. The primary and secondary windings of the balancing transformer 57 correspond to each other in number of turns thereof. In this embodiment, one end of the secondary winding of the first step-up transformer 54 is adapted to be coupled electrically to the first and second discharge lamps 511, 512 of the first lamp set 51, and to the fifth and sixth discharge lamps 521, 522 of the second lamp set 52. One end of the secondary winding of the second step-up transformer 55 is adapted to be coupled electrically to the third and fourth discharge lamps 513, 514 of the first lamp set 51, and to the seventh and eighth discharge lamps 523, 524 of the second lamp set 52. The other end of the secondary winding of each of the first and second step-up transformers 54, 55 is coupled electrically to one end of a corresponding one of the primary and secondary windings of the balancing transformer 57. The other end of each of the primary and secondary windings of the balancing transformer 57 is grounded.

The current balancer 56 includes first, second, third, fourth, fifth and sixth shunt transformers 561~566, each of which includes primary and secondary windings. One end of each of the primary and secondary windings of the first shunt transformer 561 is adapted to be coupled electrically to a corresponding one of the first and second discharge lamps 511, 512 of the first lamp set 51. The other end of the primary winding of the first shunt transformer 561 is coupled electrically in series to the other end of the secondary winding of the first shunt transformer 561. One end of each of the primary and secondary windings of the second shunt transformer 562 is adapted to be coupled electrically to a corresponding one of the third and fourth discharge lamps 513, 514 of the first lamp set 51. The other end of the primary winding of the second shunt transformer 562 is coupled electrically in series to the other end of the secondary winding of the second shunt transformer 562 and to the other ends of the primary and secondary windings of the first shunt transformer 561 via the primary winding of the third shunt transformer 563. One end of each of the primary and secondary windings of the fourth shunt transformer 64 is adapted to be coupled electrically to a corresponding one of the fifth and sixth discharge lamps 521, 522 of the second lamp set 52. The other end of the primary winding of the fourth shunt transformer 564 is coupled electrically in series to the other end of the secondary winding of the fourth shunt transformer 564. One end of each of the primary and secondary windings of the fifth shunt transformer 565 is adapted to be coupled electrically to a corresponding one of the seventh and eighth discharge lamps 523, 524 of the second lamp set 52. The other end of the primary winding of the fifth shunt transformer 565 is coupled electrically in series to the other end of the secondary winding of the fifth shunt transformer 565 and to the other ends of the primary and secondary windings of the fourth shunt transformer 564 via the primary winding of the sixth shunt transformer 566. The secondary windings of the third and sixth shunt transformers 563, 566 are coupled electrically to each other in a serial ring configuration. The third and sixth shunt transformers 563, 566 mirror the current flowing through the first and second shunt transformers 561, 562 to the second lamp set 52.

The third and sixth shunt transformers 563, 566 have identical ratios of numbers of turns between the primary and secondary windings thereof. Since the secondary windings of the third and sixth shunt transformers 563, 566 are coupled electrically to each other in the serial ring configuration, the currents flowing therethrough are nearly the same, such that the currents flowing through the primary windings of the third and sixth shunt transformers 563, 566 have a ratio of approximately 1:1. The primary and secondary windings of each of the first, second, fourth and fifth shunt transformers 561, 562, 564, 565 correspond to each other in number of turns thereof. Therefore, the currents flowing through the primary and secondary windings of each of the first, second, fourth and fifth shunt transformers 561, 562, 564, 565 have a ratio of approximately 1:1. Consequently, differences among the currents flowing through the first to eighth discharge lamps 511~514, 521~524 are small.

It should be noted herein that, similar to the first preferred embodiment, the balancing transformer 57 is optional in other implementations of the present invention. However, current balancing effects of the current balancing circuit will be slightly degraded in the absence of the balancing transformer 57, where the other ends of the secondary windings of the first and second step-up transformers 54, 55 are grounded.

It should also be noted herein that in the absence of the second step-up transformer 55, i.e., the current balancing circuit only includes one step-up transformer 54, the other end of the secondary winding of the step-up transformer 54 is adapted to be coupled electrically to the third and fourth discharge lamps 513, 514 of the first lamp set 51 and to the seventh and eighth discharge lamps 523, 524 of the second lamp set 52.

Figure 7:
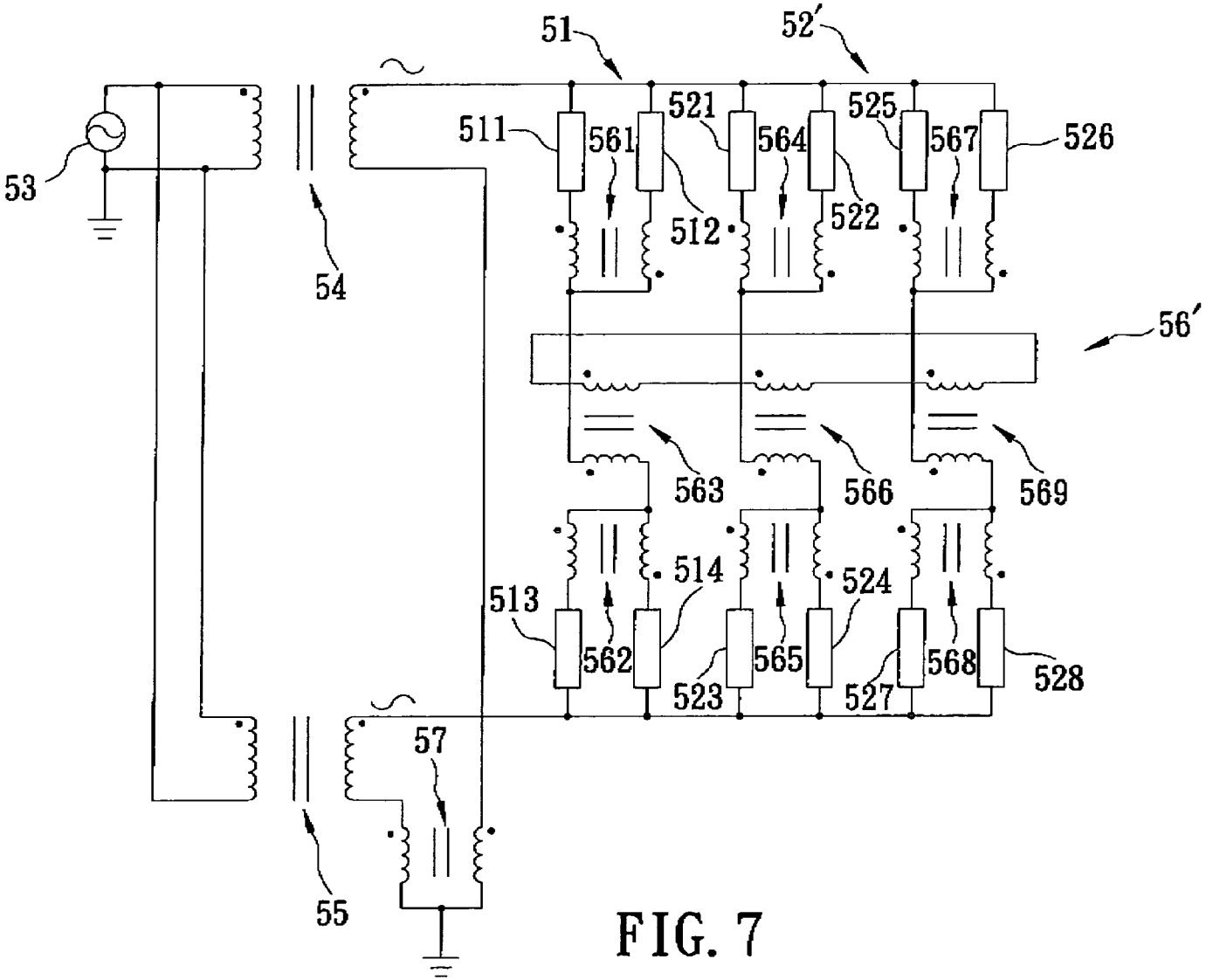
FIG. 7 is a schematic circuit diagram, illustrating a second implementation of the second preferred embodiment.

Shown in FIG. 7 is a second implementation of the second preferred embodiment, where the second lamp set 52' further includes ninth, tenth, eleventh and twelfth discharge lamps 525~528. The second implementation differs from the first implementation shown in FIG. 6 in that the current balancer 56' of the second implementation further includes seventh, eighth and ninth shunt transformers 567~569, each of which includes primary and secondary windings. The one end of the secondary winding of the first step-up transformer 54 is further adapted to be coupled electrically to the ninth and tenth discharge lamps 525, 526. The one end of the secondary winding of the second step-up transformer 55 is further adapted to be coupled electrically to the eleventh and twelfth discharge lamps 527, 528.

One end of each of the primary and secondary windings of the seventh shunt transformer 567 is adapted to be coupled electrically to a corresponding one of the ninth and tenth discharge lamps 525, 526 of the second lamp set 52'. The other end of the primary winding of the seventh shunt transformer 567 is coupled electrically in series to the other end of the secondary winding of the seventh shunt transformer 567. One end of each of the primary and secondary windings of the eighth shunt transformer 568 is adapted to be coupled electrically to a corresponding one of the eleventh and twelfth discharge lamps 527, 528 of the second lamp set 52'. The other end of the primary winding of the eighth shunt transformer 568 is coupled electrically in series to the other end of the secondary winding of the eighth shunt transformer 568 and to the other ends of the primary and secondary windings of the seventh shunt transformer 567 via the primary winding of the ninth shunt transformer 569. The secondary winding of the ninth shunt transformer 569 is coupled electrically to the secondary windings of the third and sixth shunt transformers 563, 566 in the serial ring configuration.

The third, sixth and ninth shunt transformers 563, 566, 569 have identical ratios of numbers of turns between the primary and secondary windings thereof. Since the secondary windings of the third, sixth and ninth shunt transformers 563, 566, 569 are coupled electrically to each other in the serial ring configuration, the currents flowing therethrough are nearly the same, such that the currents flowing through the primary windings of the third, sixth and ninth shunt transformers 563, 566, 569 are nearly the same as well. The primary and secondary windings of each of the fourth, fifth, seventh and eighth shunt transformers 564, 565, 567, 568 correspond to each other in number of turns thereof. Therefore, the currents flowing through the primary and secondary windings of each of the fourth, fifth, seventh and eighth shunt transformers 564, 565, 567, 568 have a ratio of approximately 1:1. Consequently, differences among the currents flowing through the first to twelfth discharge lamps 511~514, 521~528 are small.

When the number of discharge lamps included in the second lamp set 52, 52' is neither four nor eight, configuration and arrangement of the current balancer 56, 56' can be deducted from the previously described first and second implementations of the second preferred embodiment. Therefore, further details of the same are omitted herein for the sake of brevity.

Figure 8:
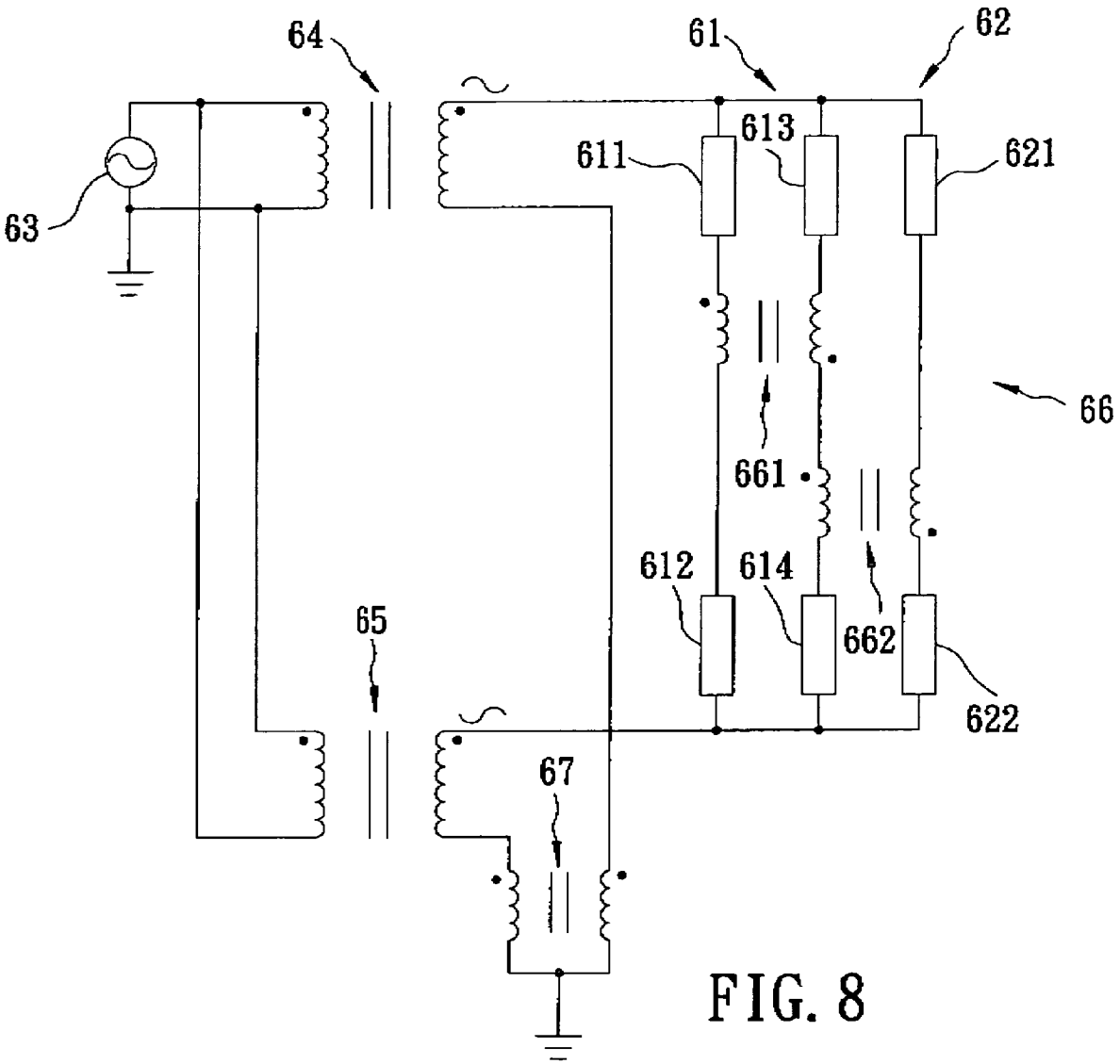
FIG. 8 is a schematic circuit diagram, illustrating a first implementation of the third preferred embodiment of a current balancing circuit according to the present invention.

Shown in FIG. 8 is a first implementation of the third preferred embodiment of a current balancing circuit for a discharge lamp unit according to the present invention. The discharge lamp unit includes a first lamp set 61 and a second lamp set 62. The first lamp set 61 includes first, second, third and fourth discharge lamps 611~614. The second lamp set 62 includes at least one discharge lamp 621. The current balancing circuit includes a step-up transformer 64 and a current balancer 66.

The step-up transformer 64 is adapted to be coupled electrically to a power supply 63 for receiving an alternating-current source power therefrom, and for generating a drive signal by varying magnitude of the alternating-current source power. The step-up transformer 64 is further adapted to be coupled electrically to the first and second lamp sets 61, 62 of the discharge lamp unit for providing the drive signal thereto.

The current balancer 66 includes a first shunt transformer 661 that includes primary and secondary windings. The primary winding of the first shunt transformer 661 is adapted to be coupled electrically between the first and second discharge lamps 611, 612 of the first lamp set 61. The secondary winding of the first shunt transformer 661 is adapted to be coupled electrically between the third and fourth discharge lamps 613, 614 of the first lamp set 61. The current balancer 66 is further adapted to mirror current flowing through the first shunt transformer 661 to the second lamp set 62. The primary and secondary windings of the first shunt transformer 661 correspond to each other in number of turns thereof. Consequently, the currents flowing through the primary and secondary windings of the first shunt transformer 661 have a ratio of approximately 1:1.

In this embodiment, the current balancer 66 further includes a second shunt transformer 662 that includes primary and secondary windings. The primary winding of the second shunt transformer 662 is adapted to be coupled electrically in series between the secondary winding of the first shunt transformer 661 and the fourth discharge lamp 614 of the first lamp set 61. The secondary winding of the second shunt transformer 662 is adapted to be coupled electrically to the at least one discharge lamp 621 of the second lamp set 62.

In the first implementation, the second lamp set 62 includes two discharge lamps, namely fifth and sixth discharge lamps 621, 622. Accordingly, the secondary winding of the second shunt transformer 662 is adapted to be coupled electrically between the fifth and sixth discharge lamps 621, 622 of the second lamp set 62. The primary and secondary windings of the second shunt transformer 662 correspond to each other in number of turns thereof. Consequently, the currents flowing through the primary and secondary windings of the second shunt transformer 662 have a ratio of approximately 1:1.

Furthermore, the current balancing circuit according to this embodiment includes two of the step-up transformers, namely first and second step-up transformers 64, 65. The first and second step-up transformers 64, 65 provide two of the drive signals to the first and second lamp sets 61, 62 in a differential manner. In addition, the current balancing circuit further includes a balancing transformer 67 that includes primary and secondary windings. The primary and secondary windings of the balancing transformer 67 correspond to each other in number of turns thereof. Each of the first and second step-up transformers 64, 65 includes primary and secondary windings. The primary windings of the first and second step-up transformers 64, 65 are adapted to be coupled electrically to the power supply 63 for receiving the alternating-current source power therefrom. One end of the secondary winding of each of the first and second step-up transformers 64, 65 is adapted to be coupled electrically to corresponding ones of the discharge lamps of the first and second lamps sets 61, 62 for providing the drive signals thereto in the differential manner.

More particularly, the one end of the secondary winding of the first step-up transformer 64 is adapted to be coupled electrically to the first and third discharge lamps 611, 613 of the first lamp set 61, and to the fifth discharge lamp 621 of the second lamp set 62, while the one end of the secondary winding of the second step-up transformer 65 is adapted to be coupled electrically to the second and fourth discharge lamps 612, 614 of the first lamp set 61, and to the sixth discharge lamp 622 of the second lamp set 62. The other end of the secondary winding of each of the first and second step-up transformers 64, 65 is coupled electrically to one end of a corresponding one of the primary and secondary windings of the balancing transformer 67. The other end of each of the primary and secondary windings of the balancing transformer 67 is grounded. The primary and secondary windings of the balancing transformer 67 correspond to each other in number of turns thereof. Consequently, the currents flowing through the primary and secondary windings of the balancing transformer 67 have a ratio of approximately 1:1.

Overall, since the numbers of turns of the primary and secondary windings of each of the first and second shunt transformers 661, 662 and the balancing transformer 67 have a ratio of 1:1, differences among the currents flowing through the first to sixth discharge lamps 611~614, 621, 622 are small.

It should be noted herein that, similar to the previous embodiments, the balancing transformer 67 is optional in other implementations of the present invention. However, current balancing effects of the current balancing circuit will be slightly degraded in the absence of the balancing transformer 67, where the other ends of the secondary windings of the first and second step-up transformers 64, 65 are grounded.

It should be further noted herein that in the absence of the second step-up transformer 65, i.e., the current balancing circuit only includes one step-up transformer 64, the other end of the secondary winding of the step-up transformer 64 is adapted to be coupled electrically to the second and fourth discharge lamps 612, 614 of the first lamp set 61 and to the sixth discharge lamp 622 of the second lamp set 62.

Figure 9:
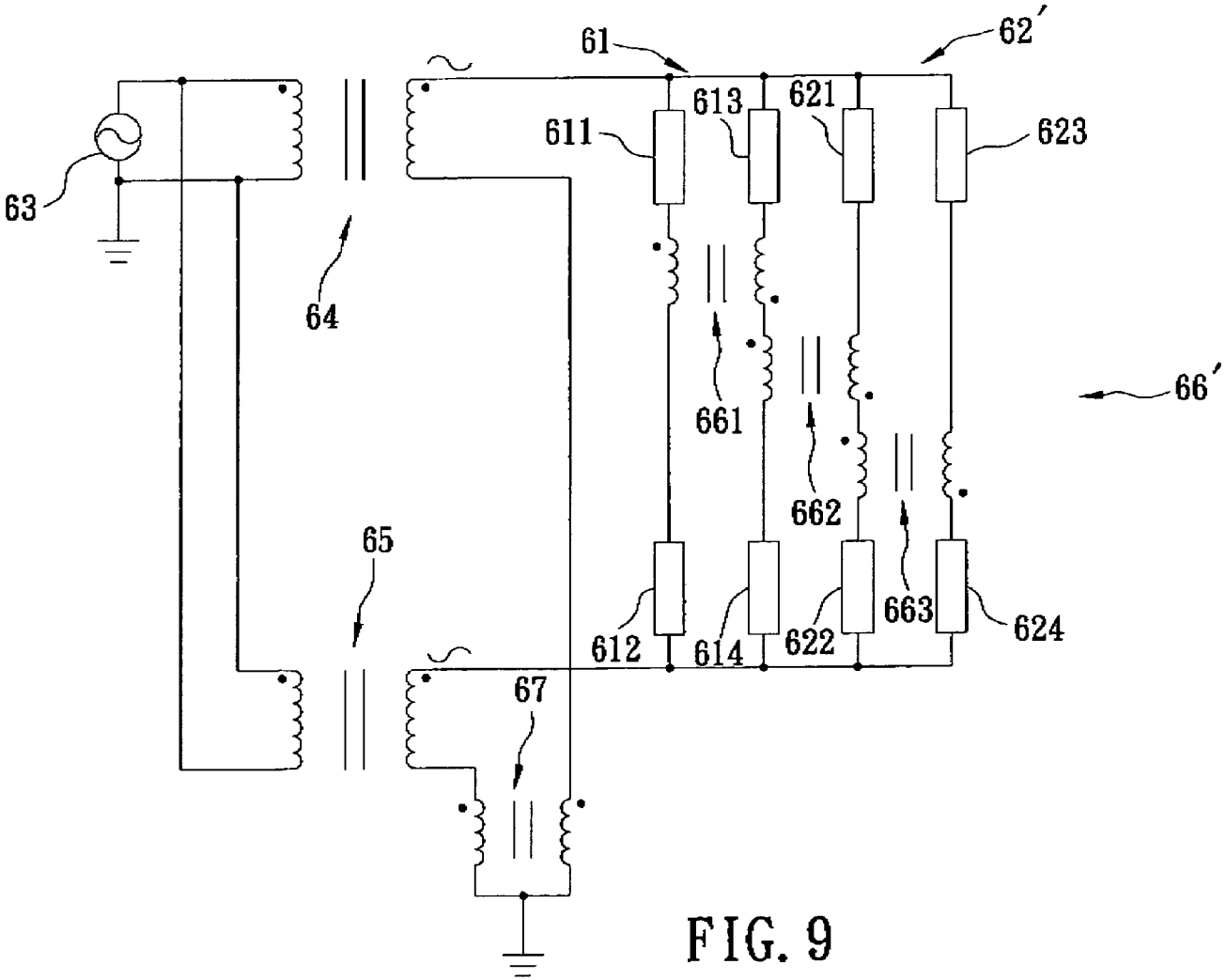
FIG. 9 is a schematic circuit diagram, illustrating a second implementation of the third preferred embodiment.

Shown in FIG. 9 is a second implementation of the third preferred embodiment of the current balancing circuit according to the present invention, where the second lamp set 62' further includes seventh and eighth discharge lamps 623, 624. The second implementation differs from the first implementation shown in FIG. 8 in that the current balancer 66' of the second implementation further includes a third shunt transformer 663 that includes primary and secondary windings. The one ends of the primary windings of the first and second step-up transformers 64, 65 are further adapted to be coupled electrically to the seventh and eighth discharge lamps 623, 624, respectively. The primary winding of the third shunt transformer 663 is adapted to be coupled electrically in series between the secondary winding of the second shunt transformer 662 and the sixth discharge lamp 622 of the second lamp set 62'. The secondary winding of the third shunt transformer 623 is adapted to be coupled electrically between the seventh and eighth discharge lamps 623, 624 of the second lamp set 62'.

The primary and secondary windings of the third shunt transformer 663 correspond to each other in number of turns thereof. Consequently, the currents flowing through the primary and secondary windings of the third shunt transformer 663 have a ratio of approximately 1:1. With the current balancer 66' so configured, differences among the currents flowing through the first to eighth discharge lamps 611~614, 621~624 are small.

Figure 10:
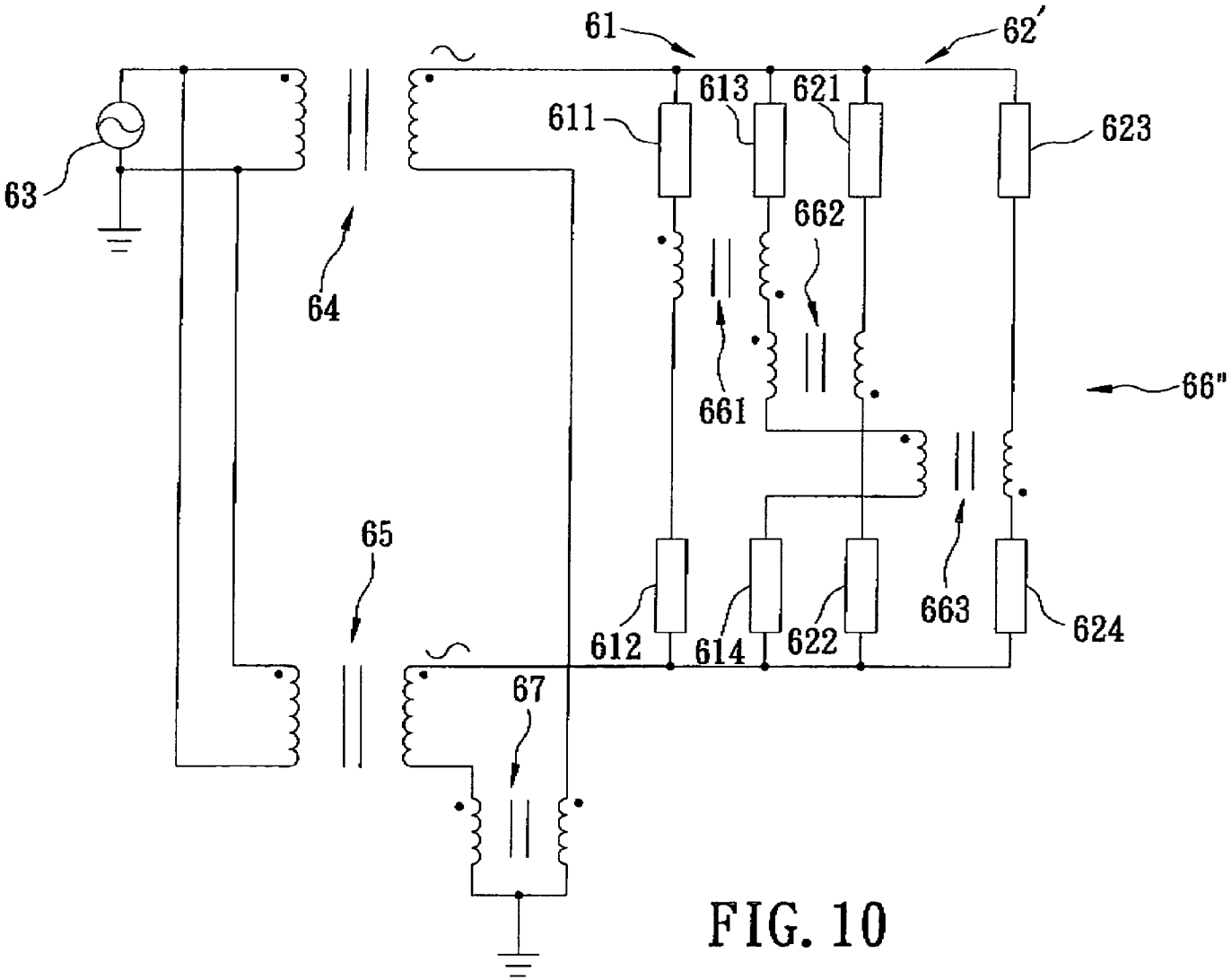
FIG. 10 is a schematic circuit diagram, illustrating a third implementation of the third preferred embodiment.

Shown in FIG. 10 is a third implementation of the third preferred embodiment, where the second lamp set 62' includes a total of four discharge lamps as with the second implementation of FIG. 9. The third implementation differs from the second implementation in the connection of the third shunt transformer 663. In particular, the primary winding of the third shunt transformer 663, the primary winding of the second shunt transformer 662 and the secondary winding of the first shunt transformer 661 are adapted to be coupled electrically in series between the third and fourth discharge lamps 613, 614 of the first lamp set 61. The secondary winding of the third shunt transformer 663 remains to be adapted to be coupled electrically between the seventh and eighth discharge lamps 623, 624 of the second lamp set 62'.

As with the second implementation of FIG. 9, the primary and secondary windings of the third shunt transformer 663 correspond to each other in number of turns thereof. Consequently, the currents flowing through the primary and secondary windings of the third shunt transformer 663 have a ratio of approximately 1:1. With the current balancer 66" so configured, differences among the currents flowing through the first to eighth discharge lamps 611~614, 621~624 are small.

When the number of discharge lamps included in the second lamp set 62, 62' is neither two nor four, configuration and arrangement of the current balancer 66, 66', 66" can be deducted from the previously described first, second and third implementations of the third preferred embodiment. Therefore, further details of the same are omitted herein for the sake of brevity.

It should be noted herein that currents flowing through a plurality of discharge lamps can be balanced by providing a current balancer that is suitably configured using any combination of the abovementioned manners.

In sum, by configuring the current balancer to be adapted to mirror current flowing through the first lamp set to the second lamp set, not only are the currents flowing through the discharge lamps of both of the first and second lamp sets balanced, but the number of shunt transformers involved are reduced as compared to the prior art. In particular, in order to drive (P) discharge lamps, (P-3) shunt transformers are required according to the first preferred embodiment, (3P/4) shunt transformers are required according to the second preferred embodiment, and (P/2-1) shunt transformers are required according to the third preferred embodiment. Consequently, manufacturing costs incurred by the current balancing circuit are reduced, thereby achieving the object of the present invention.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A current balancing circuit for a discharge lamp unit, the discharge lamp unit including a first lamp set and a second lamp set, the first lamp set including first, second, third and fourth discharge lamps, the second lamp set including at least one discharge lamp, said current balancing circuit comprising:

a step-up transformer adapted to be coupled electrically to a power supply for receiving an alternating-current source power therefrom, and for generating a drive signal by varying magnitude of the alternating-current source power, said step-up transformer being further adapted to be coupled electrically to the first and second lamp sets of the discharge lamp unit for providing the drive signal thereto; and a current balancer including first and second shunt transformers, each of said first and second shunt transformers including primary and secondary windings that correspond to each other in number of turns thereof, one end of each of said primary and secondary windings of said first shunt transformer being adapted to be coupled electrically to a corresponding one of the first and second discharge lamps of the first lamp set, the other end of said primary winding of said first shunt transformer being coupled electrically in series to the other end of said secondary winding of said first shunt transformer, one end of each of said primary and secondary windings of said second shunt transformer being adapted to be coupled electrically to a corresponding one of the third and fourth discharge lamps of the first lamp set, the other end of said primary winding of said second shunt transformer being coupled electrically in series to the other end of said secondary winding of said second shunt transformer and to said other ends of said primary and secondary windings of said first shunt transformer, said current balancer being further adapted to mirror current flowing through said first and second shunt transformers to the second lamp set.

2. The current balancing circuit as claimed in claim 1, wherein said current balancer further includes a third shunt transformer that includes primary and secondary windings, said other ends of said primary and secondary windings of said second shunt transformer being coupled electrically in series to said other ends of said primary and secondary windings of said first shunt transformer via said primary winding of said third shunt transformer, said secondary winding of said third shunt transformer being adapted to be coupled electrically to the at least one discharge lamp of the second lamp set.

3. The current balancing circuit as claimed in claim 2, the second lamp set including fifth and sixth discharge lamps, wherein said secondary winding of said third shunt transformer is adapted to be coupled electrically between the fifth and sixth discharge lamps of the second lamp set, numbers of turns of said primary and secondary windings of said third shunt transformer having a ratio of 1:2.

4. The current balancing circuit as claimed in claim 2, the second lamp set including fifth, sixth, seventh and eighth discharge lamps, wherein said current balancer further includes fourth and fifth shunt transformers, each of which includes primary and secondary windings that correspond to each other in number of turns thereof, one end of each of said primary and secondary windings of said fourth shunt transformer being adapted to be coupled electrically to a corresponding one of the fifth and sixth discharge lamps of the second lamp set, the other end of said primary winding of said fourth shunt transformer being coupled electrically in series to the other end of said secondary winding of said fourth shunt transformer, one end of each of said primary and secondary windings of said fifth shunt transformer being adapted to be coupled electrically to a corresponding one of the seventh and eighth discharge lamps of the second lamp set, the other end of said primary winding of said fifth shunt transformer being coupled electrically in series to said other end of said secondary winding of said fifth shunt transformer and to said other ends of said primary and secondary windings of said fourth shunt transformer via said secondary winding of said third shunt transformer.

5. The current balancing circuit as claimed in claim 4, wherein said primary and secondary windings of said third shunt transformer correspond to each other in number of turns thereof.

6. The current balancing circuit as claimed in claim 1, the second lamp set including fifth, sixth, seventh and eighth discharge lamps, wherein said current balancer further includes third, fourth, fifth and sixth shunt transformers, each of which includes primary and secondary windings, one end of each of said primary and secondary windings of said fourth shunt transformer being adapted to be coupled electrically to a corresponding one of the fifth and sixth discharge lamps of the second lamp set, the other end of said primary winding of said fourth shunt transformer being coupled electrically in series to the other end of said secondary winding of said fourth shunt transformer, one end of each of said primary and secondary windings of said fifth shunt transformer being adapted to be coupled electrically to a corresponding one of the seventh and eighth discharge lamps of the second lamp set, the other end of said primary winding of said fifth shunt transformer being coupled electrically in series to said other end of said secondary winding of said fifth shunt transformer and to said other ends of said primary and secondary windings of said fourth shunt transformer via said primary winding of said sixth shunt transformer, said primary winding of said third shunt transformer coupling electrically in series said other ends of said primary and secondary windings of said second shunt transformer to said other ends of said primary and secondary windings of said first shunt transformer, said secondary windings of said third and sixth shunt transformers being coupled electrically to each other in a serial ring configuration.

7. The current balancing circuit as claimed in claim 6, wherein said third and sixth shunt transformers have identical ratios of number of turns between said primary and secondary windings thereof, and said primary and secondary windings of each of said fourth and fifth shunt transformers correspond to each other in number of turns thereof.

8. The current balancing circuit as claimed in claim 6, the second lamp set further including ninth, tenth, eleventh and twelfth discharge lamps, wherein said current balancer further includes seventh, eighth and ninth shunt transformers, each of which includes primary and secondary windings, one end of each of said primary and secondary windings of said seventh shunt transformer being adapted to be coupled electrically to a corresponding one of the ninth and tenth discharge lamps of the second lamp set, the other end of said primary winding of said seventh shunt transformer being coupled electrically in series to the other end of said secondary winding of said seventh shunt transformer, one end of each of said primary and secondary windings of said eighth shunt transformer being adapted to be coupled electrically to a corresponding one of the eleventh and twelfth discharge lamps of the second lamp set, the other end of said primary winding of said eighth shunt transformer being coupled electrically in series to said other end of said secondary winding of said eighth shunt transformer and to said other ends of said primary and secondary windings of said seventh shunt transformer via said primary winding of said ninth shunt transformer, said secondary winding of said ninth shunt transformer being coupled electrically to said secondary windings of said third and sixth shunt transformers in the serial ring configuration.

9. The current balancing circuit as claimed in claim 8, wherein said third, sixth and ninth shunt transformers have identical ratios of number of turns between said primary and secondary windings thereof, and said primary and secondary windings of each of said fourth, fifth, seventh and eighth shunt transformers correspond to each other in number of turns thereof.

10. The current balancing circuit as claimed in claim 1, comprising two of said step-up transformers, said step-up transformers providing two of the drive signals to the first and second lamp sets in a differential manner.

11. The current balancing circuit as claimed in claim 10, further comprising a balancing transformer that includes primary and secondary windings, said primary and secondary windings of said balancing transformer corresponding to each other in number of turns thereof, each of said step-up transformers including primary and secondary windings, said primary windings of said step-up transformers being adapted to be coupled electrically to the power supply for receiving the alternating-current source power therefrom, one end of said secondary winding of each of said step-up transformers being adapted to be coupled electrically to corresponding ones of the discharge lamps of the first and second lamps sets for providing the drive signals thereto in the differential manner, the other end of said secondary winding of each of said step-up transformers being coupled electrically to one end of a corresponding one of said primary and secondary windings of said balancing transformer, the other end of each of said primary and secondary windings of said balancing transformer being grounded.

12. A current balancing circuit for a discharge lamp unit, the discharge lamp unit including a first lamp set and a second lamp set, the first lamp set including first, second, third and fourth discharge lamps, the second lamp set including at least one discharge lamp, said current balancing circuit comprising:

a step-up transformer adapted to be coupled electrically to a power supply for receiving an alternating-current source power therefrom, and for generating a drive signal by varying magnitude of the alternating-current source power, said step-up transformer being further adapted to be coupled electrically to the first and second lamp sets of the discharge lamp unit for providing the drive signal thereto; and a current balancer including a first shunt transformer that includes primary and secondary windings, said primary and secondary windings of said first shunt transformer corresponding to each other in number of turns thereof, said primary winding of said first shunt transformer being adapted to be coupled electrically between the first and second discharge lamps of the first lamp set, said secondary winding of said first shunt transformer being adapted to be coupled electrically between the third and fourth discharge lamps of the first lamp set, said current balancer being further adapted to mirror current flowing through said first shunt transformer to the second lamp set.

13. The current balancing circuit as claimed in claim 12, wherein said current balancer further includes a second shunt transformer that includes primary and secondary windings, said primary winding of said second shunt transformer being adapted to be coupled electrically in series between said secondary winding of said first shunt transformer and the fourth discharge lamp of the first lamp set, said secondary winding of said second shunt transformer being adapted to be coupled electrically to the at least one discharge lamp of the second lamp set.

14. The current balancing circuit as claimed in claim 13, the second lamp set including fifth and sixth discharge lamps, wherein said secondary winding of said second shunt transformer is adapted to be coupled electrically between the fifth and sixth discharge lamps of the second lamp set, said primary and secondary windings of said second shunt transformer corresponding to each other in number of turns thereof.

15. The current balancing circuit as claimed in claim 14, the second lamp set further including seventh and eighth discharge lamps, wherein said current balancer further includes a third shunt transformer that includes primary and secondary windings, said primary winding of said third shunt transformer being adapted to be coupled electrically in series between said secondary winding of said second shunt transformer and the sixth discharge lamp of the second lamp set, said secondary winding of said third shunt transformer being adapted to be coupled electrically between the seventh and eighth discharge lamps of the second lamp set, said primary and secondary windings of said third shunt transformer corresponding to each other in number of turns thereof.

16. The current balancing circuit as claimed in claim 14, the second lamp set further including seventh and eighth discharge lamps, wherein said current balancer further includes a third shunt transformer that includes primary and secondary windings, said primary winding of said third shunt transformer, said primary winding of said second shunt transformer and said secondary winding of said first shunt transformer being adapted to be coupled electrically in series between the third and fourth discharge lamps of the first lamp set, said secondary winding of said third shunt transformer being adapted to be coupled electrically between the seventh and eighth discharge lamps of the second lamp set, said primary and secondary windings of said third shunt transformer corresponding to each other in number of turns thereof.

17. The current balancing circuit as claimed in claim 12, comprising two of said step-up transformers, said step-up transformers providing two of the drive signals to the first and second lamp sets in a differential manner.

18. The current balancing circuit as claimed in claim 17, further comprising a balancing transformer that includes primary and secondary windings, said primary and secondary windings of said balancing transformer corresponding to each other in number of turns thereof, each of said step-up transformers including primary and secondary windings, said primary windings of said step-up transformers being adapted to be coupled electrically to the power supply for receiving the alternating-current source power therefrom, one end of said secondary winding of each of said step-up transformers being adapted to be coupled electrically to corresponding ones of the discharge lamps of the first and second lamps sets for providing the drive signals thereto in the differential manner, the other end of said secondary winding of each of said step-up transformers being coupled electrically to one end of a corresponding one of said primary and secondary windings of said balancing transformer, the other end of each of said primary and secondary windings of said balancing transformer being grounded.

* * * * *